United States Patent [19]

Robinson

[11] Patent Number: 4,957,131

[45] Date of Patent: Sep. 18, 1990

[54] ANIMAL WASTE FLUSHING ASSEMBLY

[76] Inventor: James L. Robinson, 1421 N. 55th St., Philadelphia, Pa. 19131

[21] Appl. No.: 324,393

[22] Filed: Mar. 16, 1989

Related U.S. Application Data

[63] Continuation-in-part of Ser. No. 137,239, Dec. 23, 1987, abandoned.

[51] Int. Cl.[5] ..... B08B 3/02

[52] U.S. Cl. ..... 134/175; 134/177; 134/182; 134/200; 134/201

[58] Field of Search ..... 134/172, 175, 177, 182, 134/198, 200, 201; 237/288, 104, 120; 15/321, 322

[56] References Cited

U.S. PATENT DOCUMENTS

| | | | |
|---|---|---|---|
| 1,929,345 | 10/1933 | Brown et al. | 15/321 |
| 3,808,631 | 5/1974 | Shibata et al. | 134/175 X |
| 4,112,535 | 9/1978 | Wild et al. | 134/198 X |
| 4,375,451 | 3/1983 | Seligman et al. | 134/172 X |
| 4,534,083 | 8/1985 | Hampson | 15/321 |
| 4,563,840 | 1/1986 | Urakami | 239/120 X |
| 4,600,149 | 7/1986 | Wakatsuki | 239/120 |
| 4,649,594 | 3/1987 | Grave | 15/321 X |
| 4,688,585 | 8/1987 | Vetter | 134/200 X |
| 4,744,380 | 5/1988 | Sheriff | 239/288 X |

*Primary Examiner*—Frankie L. Stinson

*Attorney, Agent, or Firm*—Eckert, Seamans, Cherin & Mellott

[57] ABSTRACT

An animal waste flushing assembly utilizes a domed, open-bottomed enclosure and supply and drain tubes. The supply tube is connected at one tube end to a water source and at its other end to a sprayer inside the enclosure. At the opposing enclosure end are drain means. The enclosure is placed over the animal wastes and sprayed water breaks up the wastes and flushes them out a drain tube. Disinfectant or cleanser may be added to the fluid and the drain tube may have a clip to fasten it to an in-the-ground drain grate.

24 Claims, 3 Drawing Sheets

ANIMAL WASTE FLUSHING ASSEMBLY

CROSS REFERENCE TO RELATED APPLICATION

This is a continuation-in-part of Ser. No 137,239, filed Dec. 23, 1987, now abandoned.

BACKGROUND OF THE INVENTION

1. Field of the Invention

This invention relates to animal excrement removal devices and, more particularly, to a portable flushing device with a housing for defining a temporary enclosure around the excrement and conduits for flushing a quantity of water and the excrement into a drain.

2. Description of the Prior Art

The problem of removal of animal wastes from the ground and sidewalks is a common one for pet owners. The problem is acute when a pet is contained in a small yard, which is often rendered useless for other purposes by the deposits of pet waste accumulating at unpredictable locations and times. There have been many devices marketed to aid the pet owner with waste disposal, generally intended to be useful away from the home yard. These devices are directed to collection of the feces rather than ultimate disposal of the remains. The most simple devices simply scrape the wastes into a container for later disposal. Among these collectors is that of U.S. Pat. No. 4,226,456-Barnett, which discloses a container with an integral scoop. U.S. Pat. No. 4,254,979-Bau discloses a scoop device for gathering wastes. U.S. Pat. No. 4,272,116-Tufte, Jr. discloses a collapsible container with an integral handle and a separate spatula for manually loading the waste material into the container. These devices are all used in the manner of a scraper for urging the wastes into a collection receptacle.

Others have solved the problem of waste collection with hand operated devices which employ remotely-movable scrapers having linkage-connected members operable to push the wastes into a container. Among these are U.S. Pat. No. 3,718,358-Ayers; U.S. Pat. No. 3,738,697-Kahan; and U.S. Pat. No. 4,119,337-Sherhandt.

Sherhandt is primarily directed to a pick-up device, but also discloses means to clean automatically the inner part of the receptacle and to discharge a quantity of liquid, such as a spray of disinfectant, into the container after the operation.

Some others, particularly U.S. Pat. Nos. 4,185,355-Williams and 4,478,448-Albert, have disclosed more complex devices such as powered means providing suction to pull the wastes into a container. 11 these devices are effective to confine the wastes in an inner receptacle, but that is where their convenience and effectiveness end. The user must still empty the device and probably should clean it. The effect is simply to delay facing the ultimate disposal of the mess.

In all the prior art, the direction is towards collection. Once the animal wastes have been deposited into a container, by one means or another, little thought has been given to effecting ultimate disposal or to facilitating cleanup. There is therefore, a need for an animal waste collection device which also breaks up the wastes and finally disposes of them in a sanitary and convenient manner.

SUMMARY OF THE DISCLOSURE

The aforementioned prior art problems are obviated by the animal waste flushing assembly of the present invention. A liquid supply tube, preferably having a rigid section functioning as a handle, is connected at one end, preferably by a garden hose, to a water faucet. The other end of the tube opens into one end of a domed enclosure which is deployed by the user to temporarily confine the waste over the ground surface. At an opposite end of the enclosure is a drain means. A drainage hose is preferably attached to the drain means. Means are provided to supply sufficient water, in volume, pressure and flow configuration, to break up the waste and carry it down the drainage hose. Preferably, inside the enclosure at the tube connect end is a spray nozzle which may have a plurality of openings for spray jets. The jets are directed across the enclosure (and thereby against the animal waste), toward the drain means, which can have a funnel shaped inlet. The flow pattern thus urges the waste into the drain means. The open bottom edge of the enclosure may be fitted with a resilient edging to provide a sealed closure over the wastes. A partial floor or scraper section on the domed enclosure can be used to scrape the waste into an area adjacent the drain means. One or more bottom doors can be resiliently mounted such that the bottom doors are spring biased to close and can be opened temporarily under user control to encompass the animal waste and a quantity of flush water within the domed enclosure.

In use, the enclosure is placed over the animal wastes so as to place the wastes within the enclosure and subject to the spray jets. Preferably, the wastes are carried on inside surfaces of the bottom doors, which at least partly seal off the enclosure with the wastes inside.

Pressurized water from a faucet supply or the like is then turned on, for example using a valve on the supply tubes proximal end. When water is released into the enclosure such as by activating the spray nozzle, the water is directed by the spray against the wastes and against the inner sides of the enclosure. The spray jets and the resulting turbulence break up the wastes, and the water dilutes them. At least part of the water is directed across the wastes and directly into the drain, entraining the wastes in water. Alternatively, or in addition, a quantity of fluid can be accumulated in the enclosure and flushed away suddenly by opening a gate valve along the path to the drain tube. The diluted entrained wastes are thereby sprayed and/or flushed from the enclosure, into and through the drain means, for example a tube of somewhat larger diameter than the supply. Disinfectant, cleanser, or other scented chemical or bacterial composting substances may be added to the water as it passes through the supply tube to any desired drain for the wastes. Also, a clip may affix the end of the drain means to hold and direct the ultimate end of the drain hose to a grate on a sewer inlet. If desired, the flushed wastes may be released to a garden, compost heap or the like.

It is, therefore, an object of this invention to provide an animal waste flushing assembly which not only collects animal wastes, but also breaks them up with water and flushes them finally away.

It is another of object of this invention to provide an animal waste flushing assembly which is economical and convenient to use, effectively cleaning itself with each use.

It is yet another object of this invention to provide an animal waste flushing assembly which allows the user to dispose of the wastes without touching either the wastes or the container, and avoiding any user handled scoops or similar hand tools for manipulating the waste.

It is further object of this invention to provide an animal waste flushing assembly to transport the wastes to a remote location without and physical contact by the user.

It is still another object of this invention to provide an animal waste flushing assembly which sanitizes the area of waste deposit during the removal process.

These and other objects will be more readily ascertainable to one skilled in the art from a consideration of the following figures, description and exemplary embodiments.

BRIEF DESCRIPTION OF THE DRAWINGS

There are shown in the drawings the embodiments which are presently preferred. The invention can also be realized in other groupings of specific features besides those shown, wherein.

DETAILED DESCRIPTION OF THE PREFERRED EMBODIMENTS

Figures 1, 2, 3:
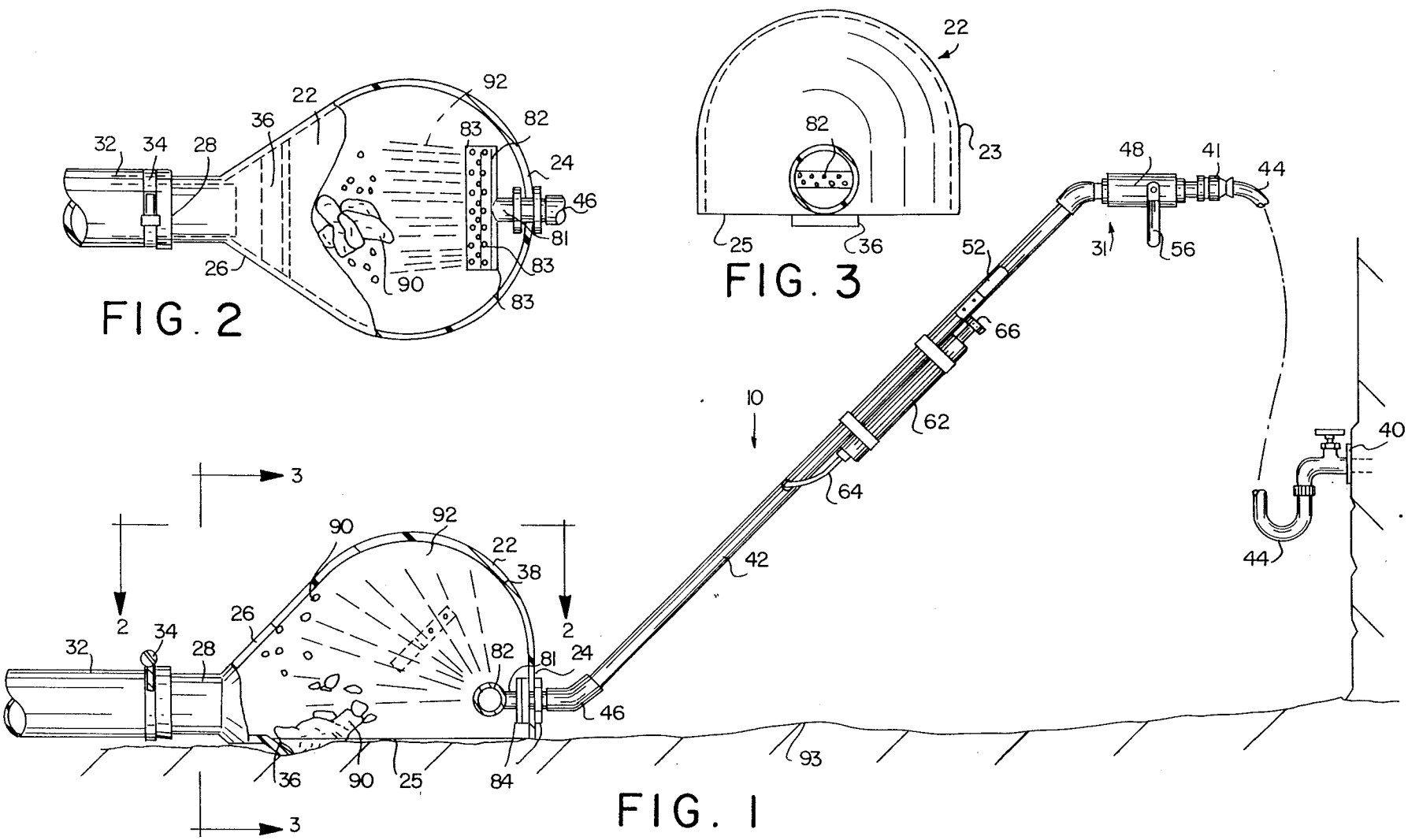
FIG. 1 is a side view in partial cross section showing the animal waste flushing assembly in use.
FIG. 2 is a cross section, taken on lines 2—2 of FIG. 1, showing the enclosure, sprayer, scraper, and drain means.
FIG. 3 is a cross section, taken on lines 3—3 of FIG. 1, showing the enclosure, scraper, and drain means.

Referring now to the drawings, and more particularly to FIGS. 1, 2 and 3, animal waste flushing device 10 is seen to have three main components: supply tube 42, enclosure 22, and drain tube 32. Supply tube 42 preferably includes a rigid tube section 31 operable as a handle, attachable by garden hose 44 to a source of water under pressure, preferably a conventional outdoor household faucet 40, by conventional hose connect 41. Supply tube 42 also includes valve 48 and may have a quick connecting off/on push connection 56. Optionally, supply tube 42 may also include disperser 62 with piston 66 and rubber tube 64 for applying scented, sanitizing or composition chemicals or the like. Elbow 46 is the joint between enclosure 22 and supply tube 42.

Figure 8:
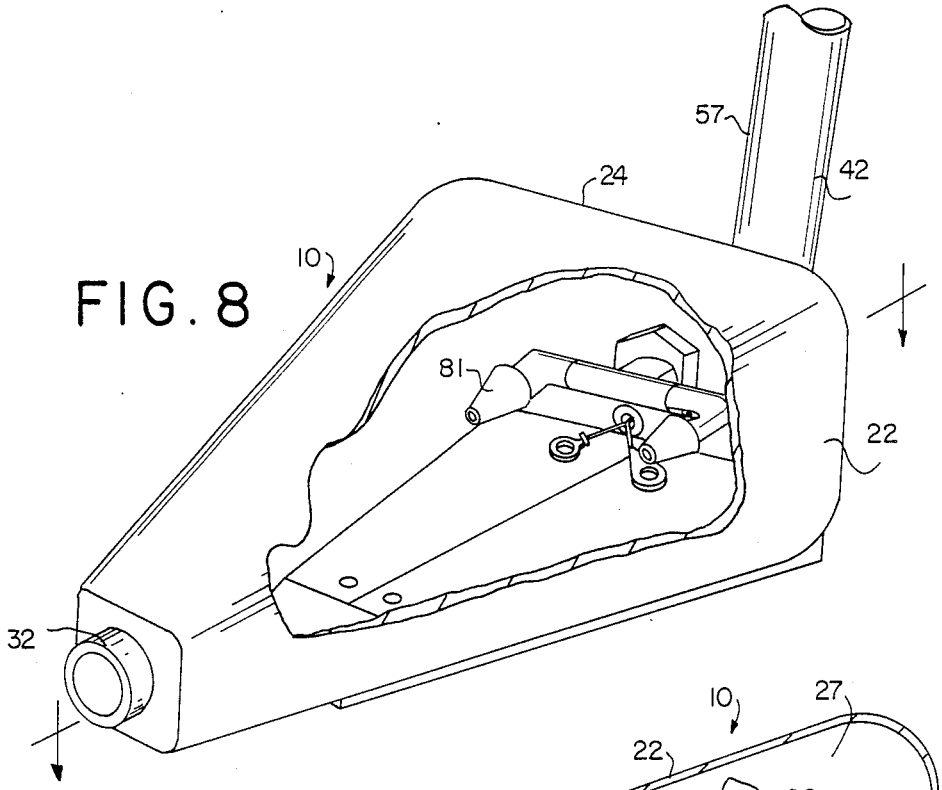
FIG. 8 is partial cutaway perspective view of an embodiment with closable bottom doors.
Figure 9:
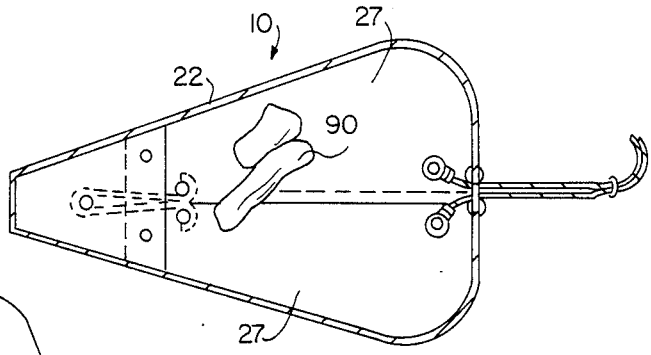
FIG. 9 is a section view along lines 9—9 in FIG. 8.
Figure 10:
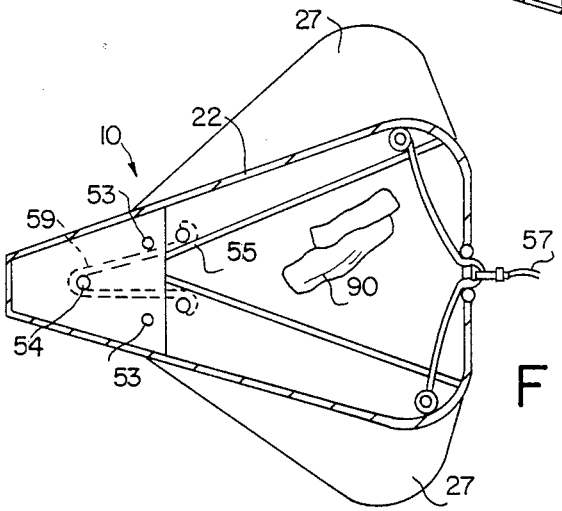
FIG. 10 is a section view corresponding to FIG. 9, with the bottom doors open.

Enclosure 22 includes nozzle 81 connected at one end to sprayer 82 at enclosure supply end 24 and at its other end to elbow 46, a sealed connection being ensured by washers 84 on either or both sides of the enclosure. At enclosure tapered end 26 is drain extension 28, attached by clamp 34 to drain tube 32. Enclosure 22 is generally a domed receptacle, opening downwardly. The open bottom may be edged with resilient edging 25 such that, when in place, the open bottom of enclosure 22 will form as tight a seal as possible with ground 93. Therefore, but for any flow into the ground, the enclosure forms a flushable temporary enclosure for the waste and for the breaking up thereof. As shown in FIGS. 8–10, and discussed in detail hereinafter, the bottom can be closeable by means of bottom doors that slide under the wastes via user control to form a temporary enclosure.

In operation, the free end of the drain tube 32 is first put at a desired location at which diluted waste will by discarded, for example a sewer drain, compost heap, etc. The user the connects supply hose 44 to supply valve 40, turns on valve 40, and places enclosure 22 over animal wastes 90 on ground 93, perhaps also enclosing the wastes via doors 27. The user then activates the water supply for flushing out the enclosure, for example by suddenly opening valve 56 to allow a gush of water into supply tube 42 and into the sprayer 80. Water entering sprayer 80 through nozzle fitting 81, is forced out through a plurality of apertures 83 to strike wastes 90 and enclosure wall 23 at a plurality of angles. Wastes 90 break apart as they are moved about in the turbulence and struck by water spray 92 which can comprise a plurality of tight jets or a less concentrated but higher volume gush of water. At least a portion of the spray is directed through the wastes and directly into the drain opening, which is formed in a funnel shape. The force of water, for example of spray 92 against wastes 90 and walls 23, dilutes wastes 90, entrains particles thereof, and flushes the entrained waste through drain extension 28 and into drain tube 32 where the diluted wastes empty onto the ground or other desired location.

Also seen in enclosure 22 is scraper 36. Scraper 36 is a flange extending inwardly into enclosure 22 and defining a partial floor section at the drain end 26 of the enclosure. The end of the flange can le bent towards the ground to aid in lifting wastes 90 from the ground and into the path of water 92 such that the user can place enclosure 22 over the waste and draw the apparatus over the ground (to the right in FIG. 1), whereupon the wastes are picked up by the scraper and held immediately in front of the drain tube orifice. In these ways, the wastes are entrained and removed and not simply beaten into the ground. The broken apart wastes are flushed away down the drain tube 32.

If the user desires, he may add disinfectant or soap to the incoming water by operating dispenser 62. Dispenser 62 has piston 66 movable in a cylinder storing the disinfectant or the like in liquid form, and rubber tube 64 connecting the outlet to tube 42. When piston 66 is operated, disinfectant, and/or deodorizer, cleanser or composting solution, is dispensed through tube 64 into tube 42 to be carried along with the water. Thus, the user may use an additive either at the time of operation, or he may use it to clean the interior of enclosure 22 after use.

Also seen on FIG. 1 are hose wrap brackets 52 and 38. For ease of storage, hose 44 may be wrapped between brackets 52 and 38. Alternatively, or in addition, drain hose 32 can be stored using brackets 52 and 38 or other similar brackets (not shown) on an opposite side of the enclosure and tube.

Figure 4:
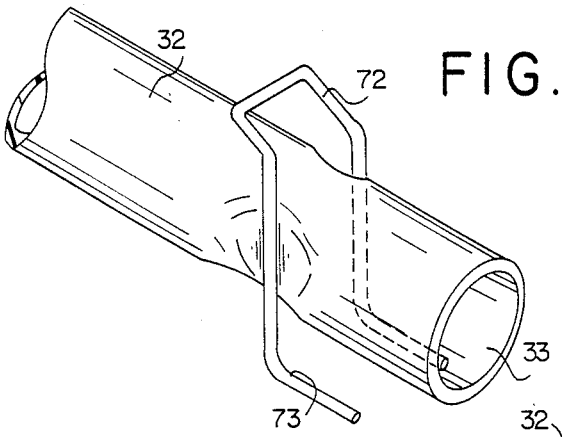
FIG. 4 illustrates the drain hose and clip.
Figure 5:
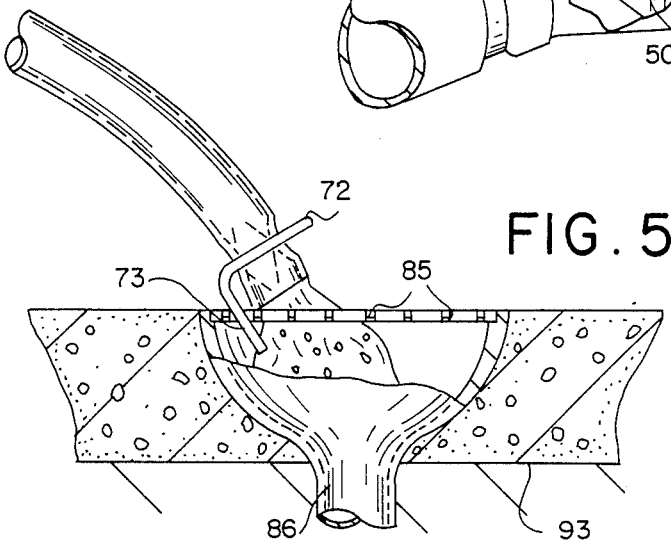
FIG. 5 shows the drain hose held on a drain grate, wastes being flushed into a sewer inlet covered by the grate.

Now referring to FIGS. 4 and 5, drain tube 32 is seen with open discharge end 33 and clip 72. Clip 72 presses resiliently against drain tube 32 at a point near its free end, and defines means for fixing the free end at a desired place of discharge.

In use, as illustrated in FIG. 5, drain tube 32 may be provided in sufficient length to extend from enclosure 22 (seen in FIGS. 1, 2 and 3) to a nearby sewer drain, or the like. Clip 72 with legs 73 is inserted into an aperture in drain grate 85 to position tube 32 so that opening 33 is angled toward the opening of drain 86, or the extending parts of clip 72 can be hooked in the webs of the grate to keep tube 32 from being pulled out of position. In this way, the user can easily dispose of the diluted animal wastes in a most sanitary and acceptable manner.

Figure 6:
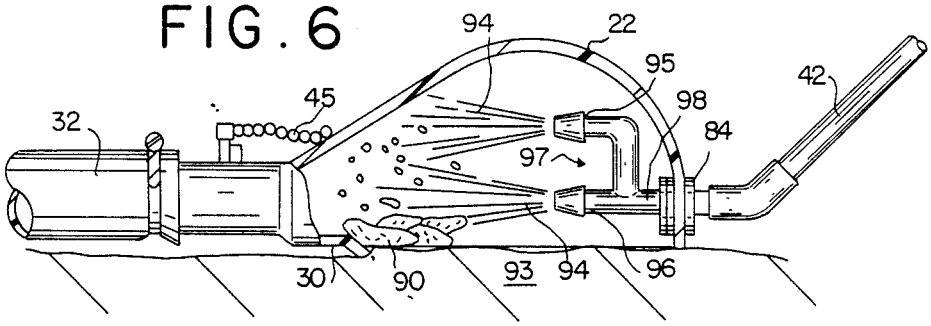
FIG. 6 is a cross section of an alternative embodiment utilizing two sprayer nozzles.

Now referring to FIG. 6, an alternative embodiment of the animal waste flushing assembly is shown with enclosure 22, supply tube 42 and drain tube 32. Enclosure 22 is in place over animal wastes 90 on ground 93. Enclosure 22 includes scraper 36 and is fitted with double nozzle assembly 97, which has nozzles 95 and 96 which emit strong, coarse jets of water, fed from common pipe 98. Water spray 94 coming from nozzles 95 and 96 breaks apart wastes 90 and flushes them through drain tube 32 in a like manner as that described in reference to FIGS. 1, 2 and 3. At least one of the nozzles 96 in this embodiment can be arranged to direct a powerful stream directly through centrally placed animal wastes and into the drain pipe 32.

Figure 7:
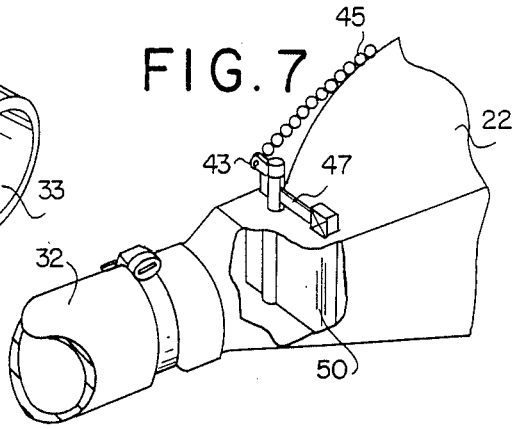
FIG. 7 is a cutaway partial perspective view showing an alternative embodiment having an outlet valve.

FIG. 7 illustrates an alternative embodiment, wherein means are provided to temporarily block the outlet and thus accumulate and then release suddenly a quantity of water. This embodiment is especially applicable where the enclosure can be relatively well sealed over wastes on a non-porous ground surface. The embodiment also operates effectively when closeable doors are included to better define a substantially closed receptacle confining the wastes as they are broken up. A pivotable outlet flapper valve 50 is closed, for example, by pressure from leaf spring 47, having a proximal end fixed to the housing at a screw block and a distal end extending through a slotted shaft by which the flapper is pivotably mounted along the passage to drain 32. Water accumulates in the enclosure when the supply is turned on, provided valve 50 is closed as shown. This outlet valve can be opened manually by rotating the flapper using the cap 43, pulled eccentrically to rotate flap 50 via chain 45. Chain 45 can lead to the handle area and can be slidably enclosed in a tube. Spring 47 may be a flat strip, tending to hold the flapper shaft in alignment. Preferably, the shaft is placed asymmetrically on the flapper such that when the valve is opened, the outlet passage is substantially unobstructed. It is also possible to arrange spring 47 to have a slight transverse arc, similar to a metal tape measure, whereby spring 47 will remain stiff until a predetermined pressure of water overcomes the stiffness, suddenly releasing the flapper and emptying the enclosure. Such an automatic release can be provided instead of, or in addition to, an opening control chain device.

FIGS. 8–10 illustrate in detail the embodiment with pivoting bottom doors 27. According to this embodiment, the enclosure 10 is similar to that described above in that enclosure 10 has a wider end 24 and narrows to a drain tube 32 at the opposite end. One or more spray nozzles 81 are directed across the enclosure, directing a substantial part of their spray directly into drain 32 and thereby will carry away a substantial portion of the waste. In this embodiment, bottom doors 27 are provided to pivot on pivot pins 53, for example heavy rivets passed through the scraper section 36, in this case a flat scraper section. Doors 27 lap one another along a center line of enclosure 10 when closed. Preferably, a spring 59, mounted on a spring pin 54 and adapted to bear outwardly against stops 55 on doors 27 urges the doors to be normally open. A cable 57 is provided for drawing doors 27 together, the cable 57 being connected to the doors 27 at cable connectors 58, located remote from the pivots 53.

Cable 57 extends upwardly along the surface of the supply tube/handle 42, in the same manner as the control for the gate valve (see FIG. 7). At ends nearest the connections to doors 27, cable 57 passes through a grommet in the end 24 of enclosure 10, for example immediately under the spray nozzle(s) 81, as shown in FIG. 8.

During operation, the user places enclosure 10 over animal wastes 90, as shown in FIG. 10. Doors 27 are then drawn closed by pulling on cable 57, possibly while also drawing the enclosure 10 from left to right as shown in FIG. 9 and 10, and the positioning the waste 90 more nearly adjacent drain 32. The enclosure 10 is now substantially closed by means of doors 27, and the waste situated therein. The user then operates the water supply valve to break up and entrain the wastes, possibly also operating the gate valve as shown in FIG. 7 to accumulate a supply of water to be flushed, removing the wastes 90 in a sanitary manner.

It is possible to arrange doors 27 to be normally open or normally closed. It is also possible to employ the bottom closing doors 27 either with or without the gate valve, however, the gate valve is preferred because by accumulating a quantity of water it is possible to operate effectively with a smaller diameter drain tube. In the embodiment of FIGS. 8–10, for example, the pressurized supply line 42 can be a half inch diameter pipe and the outlet tube 32 can be a one inch diameter pipe. Nevertheless, the device operates effectively to entrain and remove the waste 90.

There are several variations which may be practiced in the scope of this invention. Drain tube 32 may be fitted with a clip to hold it to a drain grate, or tube 32 may be provided with other means for dispersing the waste, for example with a portable wire-area emitting means to be positioned in a garden, or the like. Water may be forced into enclosure 22 by means of a multi-aperture sprayer, or it may exit through conventional hose nozzles. It is also possible to increase the flushing action of the device by accumulating a charge of water for example by filling a resilient reservoir (not shown) from the pressurized water source, and to suddenly discharge the reservoir into the enclosure. This provides a large quantity of water at a low pressure.

There are many advantages to the animal waste flushing assembly of this invention. First, the assembly provides a convenient and sanitary method of removal of household animal wastes. Second, the assembly is easy to operate and conveniently uses household water and a garden hose.

Having now illustrated and described my invention, it is not intended that such description limit this invention, but rather that this invention be limited only by reasonable interpretation of the appended claims.

I claim:

1. An assembly for flushing animal wastes from the ground, comprising:

a liquid supply tube with proximal and distal tube ends, said supply including connect means at said proximal tube end to connect said supply tube with a source of fluid under pressure;

valve means along the liquid supply tube end to regulate flow of said fluid;

connect means at said distal tube end;

a domed waste enclosure connected to said distal end, and having liquid sprayer means, and drain means, the drain means being disposed substantially at an end opposite from the sprayer means, the sprayer means directing a substantial portion of a liquid stream from the liquid supply tube through an opening defined under the domed waste enclosure, directly into said drain means, substantially parallel and adjacent to the ground when said enclosure is placed on the ground, whereby the enclosure can be placed over animal wastes on the ground, and the valve means opened, whereupon fluid from the supply breaks up the waste and flushes them through the drain means; and means for defining an enclosure extending at least partly under the animal wastes, whereby the animal wastes are at least partly confined in the enclosure under action of the spray means.

2. An assembly for flushing animal wastes from the ground, a liquid supply tube with proximal and distal tube ends, said supply including connect means at said proximal tube end to connect said supply tube with a source of fluid under pressure;

valve means along the liquid supply tube end to regulate flow of said fluid; connect means at said distal tube end; and a domed waste enclosure connected to said distal end, and having liquid sprayer means, and drain means, the drain means being disposed substantially at an end opposite from the sprayer means, the sprayer means directing a substantial portion of a liquid stream from the liquid supply tube through an opening defined under the domed waste enclosure, directly into said drain means, substantially parallel and adjacent to the ground when said enclosure is placed on the around; and, means for accumulating and releasing a quantity of fluid to flush the waste through the drain means, said means for accumulating and releasing having a valve disposed at the drain means.

3. The apparatus for flushing animal wastes from the ground according to claim 2, wherein the means for accumulating and releasing includes at least one movable door operable to temporarily close a bottom of the enclosure under the animal wastes.

4. The apparatus for flushing animal wastes from the ground according to claim 2, wherein the drain means is a tubular extension of said enclosure, and further comprising a drain tube, a proximal end of the drain tube being connected to the tubular extension.

5. The apparatus for flushing animal wastes from the ground according to claim 4, further comprising a clip on a distal end of the drain tube, operable to hold the tube at a desired point of discharge.

6. The apparatus for flushing animal wastes from the ground according to claim 2, wherein said enclosure comprises a scraper flange adjacent said drain means, the flange extending from said drain means into said enclosure substantially along a bottom edge of the enclosure whereby the scraper can pick up and position wastes at the drain means.

7. The apparatus for flushing animal wastes from the ground according to claim 2, wherein said supply tubing includes a rigid shaft section and wherein said connect means at said distal supply tube and is an elbow attached to said supply tube at the distal end, the elbow forming an angle of about 45°.

8. The apparatus for flushing animal wastes from the ground according to claim 2, further comprising means for injecting additional substances into the fluid in said supply tube.

9. The apparatus for flushing animal wastes from the ground according to claim 2, further comprising a circumferential resilient sealing means around the edge of said open bottom.

10. An assembly for flushing animal wastes from the ground, comprising:

a liquid supply tube with proximal and distal tube ends, said supply including connect means at said proximal tube end to connect said supply tube with a source of fluid under pressure;

valve means along the liquid supply tube end to regulate flow of said fluid; connect means at said distal tube end; and a domed waste enclosure connected to said distal end, and having liquid sprayer means, and drain means, the drain means being disposed substantially at an end opposite from the sprayer means, the sprayer means directing a substantial portion of a liquid stream from the liquid supply tube through an opening defined under the domed waste enclosure, directly into said drain means, substantially parallel and adjacent to the ground when said enclosure is placed on the ground; and, at least one movable door on a lower part of the enclosure, the movable door being closable under the animal wastes to thereby substantially close the enclosure around the animal wastes on all sides.

11. The apparatus for flushing animal wastes from the ground of claim 10, further comprising resilient means operable to urge the movable door open and manually operable means for counteracting the resilient means to thereby close the door.

12. The apparatus for flushing animal wastes from the ground of claim 10, further comprising means for temporarily closing the drain means thereby to accumulate a quantity of liquid in the enclosure, the quantity of liquid being suddenly released to flush the animal waste through the drain means.

13. The apparatus for flushing animal wastes from the ground of claim 12, wherein said means for temporarily closing the drain means comprises a gate valve.

14. The apparatus for flushing animal wastes from the ground of claim 10, comprising two said movable doors, pivotably mounted at spaced pivot axes adjacent the drain means, and a spring member on the housing operable to bear outwardly to said doors.

15. An assembly for flushing animal wastes from the ground, comprising:

(a) a liquid supply tube with proximal and distal tube ends, said supply tube including (i) connect means at said proximal tube end to connect said supply tube with a source of fluid under pressure;

(ii) valve means to regulate flow of said fluid through said liquid supply tube;

(iii) connect means at said distal tube ends;

(b) a domed waste enclosure connected to said distal end, and having liquid sprayer means and drain means substantially at an end of said enclosure opposite from the prayer means; and, (c) means for accumulating a quantity of fluid within said enclosure, and for releasing said accumulated quantity of fluid to flush the wastes through the drain means.

16. The assembly of claim 15, wherein the means for accumulating and releasing includes a valve disposed at the drain means.

17. The assembly of claim 16, wherein said enclosure comprises a scraper flange adjacent said drain means, said flange extending from said drain means inwardly into said enclosure substantially along on open bottom edge of the enclosure, whereby the scraper flange is manually operable to pick up and position wastes at the drain means.

18. The assembly of claim 16, wherein said supply tube includes a rigid shaft section and wherein said connect means at said distal supply tube end is an elbow attached to said supply tube at a distal end, the elbow forming an angle of about 45°.

19. The assembly of claim 16, wherein said sprayer means is adapted to direct at least a portion of a liquid stream into said drain means and substantially parallel and adjacent to the ground when said enclosures placed onto the ground.

20. The assembly of claim 16 further comprising means for injecting additive substances into the fluid in said supply tube.

21. The assembly of claim 16, further comprising a circumferential resilient sealing means around the edge of said bottom of the enclosure.

22. The assembly of claim 15, wherein the valve at the drain means is operable at least partly as a function of water pressure in the enclosure.

23. The assembly of claim 16, wherein said drain means includes a tubular extension of said enclosure and further comprises a drain tube, a proximal end of the drain tube being connected to the tubular extension.

24. The assembly of claim 23, further comprising a clip on a distal end of the drain tube, operable to hold said tube at a desired point of discharge.

* * * * *